US007084100B2

(12) United States Patent
Watson

(10) Patent No.: US 7,084,100 B2
(45) Date of Patent: Aug. 1, 2006

(54) ANTIOXIDANT COMPOSITIONS

(75) Inventor: Randall Alan Watson, Chaoyang District (CN)

(73) Assignee: The Procter & Gamble Company, Cincinnati, OH (US)

( * ) Notice: Subject to any disclaimer, the term of this patent is extended or adjusted under 35 U.S.C. 154(b) by 39 days.

(21) Appl. No.: 11/116,922

(22) Filed: Apr. 28, 2005

(65) Prior Publication Data

US 2005/0245429 A1 Nov. 3, 2005

Related U.S. Application Data

(60) Provisional application No. 60/565,987, filed on Apr. 28, 2004.

(51) Int. Cl.

| | |
|---|---|
| ***C11D 1/00*** | (2006.01) |
| ***C11D 3/28*** | (2006.01) |
| ***C11D 3/30*** | (2006.01) |
| ***C11D 3/37*** | (2006.01) |

(52) U.S. Cl. ..... 510/356; 510/357; 510/475; 510/499; 510/500; 510/503

(58) Field of Classification Search ..... None
See application file for complete search history.

(56) References Cited

U.S. PATENT DOCUMENTS

| | | | |
|---|---|---|---|
| 5,789,373 | A | 8/1998 | Baker et al. |
| 5,854,200 | A | 12/1998 | Severns et al. |
| 6,001,794 | A | 12/1999 | Del Duca et al. |
| 6,121,223 | A | 9/2000 | Dixon et al. |
| 2002/0143025 | A1 | 10/2002 | Pratt et al. |

FOREIGN PATENT DOCUMENTS

| | | | |
|---|---|---|---|
| EP | 0 294 096 | A1 | 12/1988 |
| EP | 0 320 219 | B1 | 3/1994 |
| EP | 0 843 001 | A1 | 5/1998 |
| EP | 0 752 469 | B1 | 9/2004 |
| JP | 10-237488 | | 9/1998 |
| JP | 2002-080893 | | 3/2002 |
| WO | WO 94/26860 | A1 | 11/1994 |
| WO | WO 96/03481 | A1 | 2/1996 |
| WO | WO 96/06151 | A1 | 2/1996 |

OTHER PUBLICATIONS

PCT International Search Report, Jul. 27, 2005.

Derek A. Pratt, Gino A. Dilabio, Giovanni Brigati, Gian Franco Pedulli and Luca Valgimigli, Pyrimidinols: Novel Chain-Breaking Antioxidants More Effective than Phenols, Jan. 16, 2001, 4625-4626, American Chemical Society.

Maikel Wijtmans, Derek A. Pratt, Luca Valigmigli, Gino A. Dilabio, Gian Franco Pedulli and Ned A. Porter, 6-Amino-3-Pyridinols: Towards Diffusion-Controlled Chain-Breaking Antioxidants, Ed 2003, 42, 4370-4373, Agnew Chem. Int., no month available.

Sean M. Culbertson, Gary D. Enright, and K. U. Ingold, Synthesis of a Novel Radical Trapping and Carbonyl Group Trapping Anti-AGE Agent: A Pyridoxamine Analogue for Inhibiting Advanced Glycation and Lipoxidation End Products, Organic Letters, vol. 5, No. 15, pp. 2659-2662, May 12, 2003, American Chemical Society.

*Primary Examiner*—Gregory R. Del Cotto
(74) *Attorney, Agent, or Firm*—Julia A. Glazer; David V. Upite

(57) ABSTRACT

The present invention is directed to a composition having from about 0.005% to about 5% by weight, preferably, from about 0.01% to about 1% by weight of an antioxidant. The composition is selected from the group consisting of a laundry detergent composition, a fabric softening composition, a dish care composition, a personal cleansing composition, a shampoo composition, a rinsing composition and a conditioner composition.

5 Claims, No Drawings

ANTIOXIDANT COMPOSITIONS

CROSS REFERENCE TO RELATED APPLICATION

This application claims the benefit of U.S. Provisional Application No. 60/565,987, filed Apr. 28, 2004, the disclosure of which is incorporated by references.

FIELD OF THE INVENTION

The present invention relates to a composition having an antioxidant.

BACKGROUND OF THE INVENTION

Users experience color damage to their clothing from exposure to the sun during drying. Despite extensive efforts by the textile industry to develop light stable dyes and after-treatments to improve light-fastness of dyes, the fading of clothing still remains a problem.

In addition, after cleaning clothes, users may see clothes turned yellowing. These phenomenons may be caused by oxidation caused by free-radicals.

In order to prevent these, it is known to formulate antioxidants into detergents or softeners. However, because antioxidant compounds are expensive, it is desirable to select and utilize the most efficient compounds in order to minimize the cost of the compositions.

Attempts, thus far to minimize or eliminate the fading of fabrics from the sun via a fabric care composition have been unsatisfactory due to higher cost, the difficulty of providing broad spectrum protection, formulation difficulties, etc.

Therefore, an object of the present invention is to provide a fabric care composition with an antioxidant compound, effective at low levels.

SUMMARY OF THE INVENTION

The present invention relates to a composition comprising from about 0.005% to about 5% by weight, preferably, from about 0.01% to about 0.5% by weight of an antioxidant. The composition of the present invention is selected from the group consisting of a laundry detergent composition, a fabric softening composition, a dish care composition, a fabric treatment composition, a personal cleansing composition, a shampoo composition, a rinsing composition and a conditioner composition.

In the present invention, the antioxidant is preferably selected from the group consisting of a substituted 5-pyrimidinol, a substituted 3-pyridinol and a mixture thereof. Preferably, the substituted 5-pyrimidinol or substituted 3-pyridinol of the present invention has an O—H bond dissociation enthalpy of less than about 90 kcal/mol, more preferably, less than about 80 kcal/mol, and further more preferably less than about 75 kcal/mol. Also, the substituted 5-pyrimidinol or substituted 3-pyridinol of the present invention preferably has an ionization potential of more than about 140, more preferably, more than about 150 kcal/mol.

While not intending to be limited by theory, it is believed that the antioxidation mechanism relies on the transfer of phenolic H-atoms to a chain propagating peroxy radical. The more exothermic this transfer occurs, the better the chain-breaking antioxidant happens. It has been shown that Bond Dissociation Enthalpy (BDE) can be utilized to predict the rate of this reaction, and hence is a good screening measure for such antioxidants. Thus, as long as one compound has lowered the BDE, the compound may show better antioxidant capability.

The issue with simply decreasing BDE is that most efforts also result in decreased ionization potentials (IP). As the IP decreases the antioxidants have increasing reactivity directly with oxygen. Such reactions render the antioxidant impotent for radical scavenging.

The composition of the present invention may provide many advantages such as: (1) water solubility, (2) high performance and (3) less fabric yellowing. In contrast, the current antioxidants are typically not readily water soluble or dispersible. Thus, it is difficult to formulate them into laundry detergent or fabric softening compositions in a sufficient amount. As a result, sufficient antioxidant property cannot always be provided. Also, current antioxidants possess a low weight effectiveness and/or deposition efficiency and thus, require incorporation in to products at higher levels in products, which may make them too expensive for consumer products. In addition, current antioxidants themselves result in yellow color. Thus, once they are formulated into laundry detergent or fabric softening products, after treated, clothes may be result in yellowing, in which users do not prefer.

As the antioxidant used in the present invention has a higher antioxidant capability, it may be formulated into products given at a low level and still provide an antioxidant benefit. As a result, the composition of the present invention may provide these advantages as above.

DETAILED DESCRIPTION OF THE INVENTION

Definition

All percentages, ratios and proportions herein are by weight of the composition, unless otherwise specified. All temperatures are in degrees Celsius (° C.) unless otherwise specified.

As used herein, the term "comprising" and its derivatives means are intended to be open ended terms that specify the presence of the stated features, elements, components, groups, integers, and/or steps, but do not exclude the presence of other, unstated features, elements, components, groups, integers, and/or steps. This definition also applies to words of similar meaning, for example, the term "have", "include", "be provided with" and their derivatives. This term encompasses the terms "consisting of" and "consisting essentially of".

Antioxidant

The composition of the present invention has from about 0.005% to about 5% by weight, preferably, from about 0.01% to about 1%, more preferably, from about 0.01% to about 0.5% by weight of an antioxidant. The antioxidant is preferably selected from the group consisting of a substituted 5-pyrimidinol, a substituted 3-pyridinol and a mixture thereof. The substituted 5-pyrimidinol or substituted 3-pyridinol comprises: an O—H bond dissociation enthalpy of less than about 90 kcal/mol, preferably, less than about 80 kcal/mol, and more preferably less than about 75 kcal/mol and an ionization potential of more than about 140 kcal/mol, preferably, more than about 150 kcal/mol.

The substituted 5-pyrimidinol or substituted 3-pyridinol has a phenolic O—H BDE low enough to yield very high rates of phenolic H-atom transfer, but yet also has a high ionization potential so as to avoid direct reactivity with oxygen (details are described in Pratt, et al. US 2002/0143025A1, published on Oct. 3, 2002).

The phenolic O—H BDE may be determined experimentally by measuring the equilibrium constants for H-atom transfer between phenols and the corresponding phenoxyl radicals generated via photolysis in deoxygenated benzene solutions in an electron paramagnetic resonance (EPR)

cavity. The resulting equilibrium constants are linearly related to the bond dissociation energy. This radical-equilibration EPR method is described in M. Lucarini et al, *J. Amer. Chem. Soc.,* 1999, vol. 121, pp. 11546–11553 and M. Lucarini et al, *J. Org. Chem.,* 1996, vol. 61, pp. 9259–9263.

Alternatively, BDE may be calculated using density functional theory models as described in G. A. DiLabio et al, *J. Phys. Chem. A.,* 1999, 103, 1653–1661. Likewise, Ionization Potential relative to benzene can be calculated using density functional theory models as described in G. A. DiLabio et al, *J. Org. Chem.,* 2000, 65, 2195–2203. Simple solution stability experiments can also be used to rapidly confirm the ionization potential is sufficiently high to avoid significant direct reactivity with oxygen.

However, preferable method to measure BDE is the calculation method described in G. A. DiLabio et al.

More preferably, the substituted 5-pyrimidinol of the present invention has the structure:

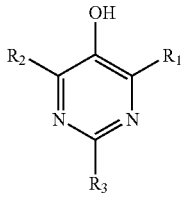

wherein $R_1$ and $R_2$ are independently selected from the group consisting of hydrogen, methyl, ethyl, propyl, n-butyl and t-butyl, preferably selected from the group consisting of hydrogen, methyl, propyl and t-butyl; and $R_3$ is selected from the group consisting of alkoxy, amino, N-alkylamino, and N, N-dialkylamino. When $R_3$ is N-alkylamino or N, N-diaklylamino, the alkyl group can be selected from the group consisting of methyl, ethyl, propyl, n-butyl, t-butyl, pentyl, octyl and phytyl, preferably selected from the group consisting of methyl, ethyl, t-butyl, pentyl, octyl and phtyl.

Further more preferably, the substituted 5-pyrimidinol has the structure:

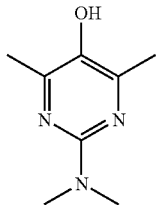

Also, more preferably, the substituted 3-pyridinol of the present invention has the structure selected from the group consisting of:

i)

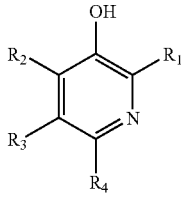

wherein $R_1$, $R_2$ and $R_3$ are independently selected from the group consisting of hydrogen, methyl, ethyl, propyl, n-butyl and t-butyl, preferably selected from the group consisting of hydrogen, methyl and t-butyl; and $R_4$ is selected from the group consisting of alkoxy, amino, N-alkylamino, and N, N-dialkylamino. When $R_4$ is N-alkylamino or N, N-diaklylamino, the alkyl group can be selected from the group consisting of methyl, ethyl, propyl, n-butyl, t-butyl, pentyl, octyl and phytyl, preferably selected from the group consisting of methyl, t-butyl, pentyl, octyl and phytyl.

ii)

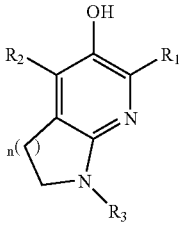

wherein n=1 or 2; $R_1$ and $R_2$ are independently selected from the group consisting of hydrogen, methyl, ethyl, propyl, n-butyl and t-butyl, preferably selected from the group consisting of hydrogen, methyl and t-butyl.

More preferably, the substituted 3-pyridinol of the present invention has the structure selected from the group consisting of:

i)

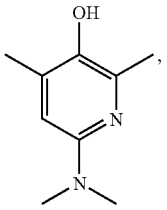

ii)

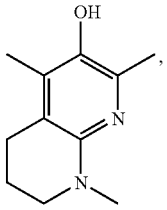

iii)

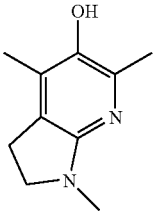

and a mixture thereof.

One of the preferred substituted 3-pyridinols is described in M. Wijtmans, D. A. Pratt, L. Valgimigli, G. A. DiLabio, G. F. Pedulli, N. A. Porter, *Agnew. Chem. Int. Ed.,* 2003, vol. 42, pp. 4370–4373. One of the preferable substituted 5-pyrimidinols is described in D. A. Pratt, G. A. DiLabio, G. Brigati, G. F. Pedulli, L. Valgimigli, *J. Amer. Chem. Soc.,* 2001, vol. 123, pp. 4625–4626. Both classes are also disclosed in Pratt, et al., US 2002/0143025A1, published on Oct. 3, 2002.

Optional Ingredients

The composition of the present invention may also include one or more optional ingredients, such as a surfactant, softening active, dye transfer inhibiting agent, dye fixative, suds suppressor and other ingredients.

Surfactant

The composition of the present invention, preferably a laundry detergent composition or a dish care composition may comprise from about 0.01% to about 50%, preferably from about 5% to about 30% by weight of a surfactant. The surfactant is preferably selected from the group consisting of anionic surfactant, nonionic surfactant, cationic surfactant, amphoteric surfactant and a mixture thereof.

Preferably surfactant is described in U.S. Pat. No. 6,391,839 to Addison, issued May 21, 2002.

Softening Active

The composition of the present invention, preferably a fabric softening composition may comprise from about 0.01% to about 50%, preferably from about 3% to about 35% by weight of a softening active. The preferable softening active is described in U.S. Pat. No. 4,844,820, to Piper et al., issued on Jul. 4, 1989.

Dye Transfer Inhibiting Agent

The composition of the present invention, preferably, a laundry detergent composition may comprise from about 0.01% to 10% by weight of a dye transfer inhibiting agent. The dye transfer inhibiting agent is preferably selected from the group consisting of polyamine N-oxide polymers, copolymers, N-vinylpyrollidone, N-vinylimidazole and a mixture thereof Dye-Fixative Agent The composition of the present invention, preferably, a laundry detergent composition may comprise from about 0.1% to about 8% by weight of a dye-fixative agent. A preferable dye-fixative agent is a polyamide-polyamine polymer described in U.S. Pat. No. 6,140,292, to Randall et al., issued on Jun. 30, 1999.

Suds Suppressor

The composition of the present invention, preferably, a laundry detergent composition or a fabric treatment composition may comprise from about 0.1% to about 10%, preferably, from about 0.5% to about 5% by weight of a suds suppressor. A preferable suds suppressor is described in U.S. Pat. No. 4,732,694 to Gowland et al, issued on Mar. 22, 1988. One preferable example of suds suppressors is Silicone emulsion SE39, available from Wacker and Silicone 3565, available from Dow Corning.

Other Ingredient

The composition of the present invention may further comprise a builder, an enzyme, a dye, a perfume or other conventional ingredients.

EXAMPLES

The following examples further describe and demonstrate the preferred embodiments within the scope of the present invention. The examples are given solely for the purpose of illustration, and are not to be construed as limitations of the present invention since many variations thereof are possible without departing from its spirit and scope.

Example 1

Compositions (1)–(5) of Example 1 show laundry detergent compositions of the present invention.

Laundry detergent Composition:

| | weight % | | | | |
|---|---|---|---|---|---|
| Ingredients | (1) | (2) | (3) | (4) | (5) |
| LAS | 15 | 9.3 | 8 | 20 | 13.3 |
| AS | | 12.8 | | | 3.9 |
| AES | | | | | 2.0 |
| AE | 1.8 | 1.5 | 5.4 | 1.5 | 0.5 |
| Enzyme | 0.35 | 0.59 | | 0.8 | 1.6 |
| Antioxidant A*[1] | 0.05 | — | | 0.2 | |
| Antioxidant B*[2] | — | 0.5 | 0.02 | | 0.25 |
| Dye fixative agent*[3] | | 2.0 | | | 2.0 |
| Dye transfer inhibiting agent*[4] | | 0.2 | | 0.4 | |
| MA/AA copolymer | 0.80 | 2.3 | 1.2 | 2.2 | 3.5 |
| STPP | 25 | | | | |
| Zeolite | | 27.8 | | 32 | 26.3 |
| Sodium silicate | | | 8 | 2 | 2.4 |
| Sodium carbonate | 15 | 27.3 | 8 | | 23.9 |
| Sodium sulphate | 35 | | 66 | 20 | 10.5 |
| Perfume, Minors | Bal. | Bal. | Bal. | Bal. | Bal. |

*[1]substituted 5-pyrimidinol(2-N,N-dimethylamino-4,6-dimethyl-5-hydroxypyrimidine)

*[2]substituted 3-pyridinol(2,4-dimethyl-6-N,N-dimethylamino-3-hydroxypyridine)

*[3]copolymer of 1-H Imidazole and epichlorohydrin

*[4]polyamine N-oxide polymers

Example 2

Compositions (1)–(5) of Example 2 show fabric softening compositions of the present invention.

Fabric Softening Composition:

| | weight % | | | | |
|---|---|---|---|---|---|
| Ingredients | (1) | (2) | (3) | (4) | (5) |
| Di-C10 Quat*[1] | 30 | 20 | 15 | 10 | 5 |
| Di-C18 Quat*[2] | 5 | 15 | 20 | 25 | 30 |
| C12 Quat*[3] | 0 | 0 | 5 | 5 | 5 |
| Hexanediol | 0 | 0 | 2 | 5 | 7 |
| Decanoic acid | 5 | 5 | 5 | 5 | 5 |
| Tetradecyl alcohol | 7 | 0 | 0 | 0 | 0 |
| Cholesterol | 1 | 0 | 0 | 0 | 0 |
| $CaCl_2$ | 0.3 | 0.3 | 0.3 | 0.3 | 0.3 |
| Antioxidant A*[6] | 0.01 | | 0.5 | | |
| Antioxidant B*[7] | | 0.05 | | 0.25 | 0.02 |
| Ethanol | 2.47 | 2.47 | 2.47 | 2.47 | 2.47 |
| Dye fixative agent*[8] | | 2.0 | | | 2.0 |
| Dye transfer inhibiting agent*[9] | | 0.2 | | 0.4 | |
| HEDP*[4] | 0.05 | 0.05 | 0.05 | 0.05 | 0.05 |
| Perfume | 0.3 | 0.3 | 0.3 | 0.3 | 0.3 |
| HCl | 0.01 | 0.01 | 0.01 | 0.01 | 0.01 |
| C16 benzalkonium chloride*[5] | 0.1 | 0.1 | 0.1 | 0.1 | 0.1 |

-continued

Fabric Softening Composition:

| Ingredients | weight % (1) | (2) | (3) | (4) | (5) |
|---|---|---|---|---|---|
| Acid Blue 80 | 0.001 | 0.001 | 0.001 | 0.001 | 0.001 |
| Water & minors | Bal. | Bal. | Bal. | Bal. | Bal. |

*1Didecyl dimethyl ammonium chloride
*2Distearyl dimethyl ammonium chloride
*3Dodecyl trimethyl ammonium chloride
*41-Hydroxyethane-1,1-diphosphonate
*5Hexadecyl dimethyl benzalkonium chloride
*6substituted 5-pyrimidinol(2-N,N-dimethylamino-4,6-dimethyl-5-hydroxypyrimidine)
*7substituted 3-pyridinol(2,4-dimethyl-6-N,N-dimethylamino-3-hydroxypyridine)
*8copolymer of 1-H Imidazole and epichlorohydrin
*9polyamine N-oxide polymers

Example 3

Fabric Treatment Composition:

| Ingredients | weight % (1) | (2) | (3) | (4) |
|---|---|---|---|---|
| Suds suppressor A*1 | 1.3 | 0.75 | | |
| Suds suppressor B*2 | | | 2.0 | 1.2 |
| Gum A*3 | 0.26 | | 0.40 | |
| Gum B*4 | | 0.50 | | 0.70 |
| Colorant | 0.01 | 0.01 | 0.01 | 0.01 |
| Antibacterial agent | | | | 1 |
| Antioxidant A*5 | 0.50 | | 0.02 | |
| Antioxidant B*6 | | 0.35 | | 0.05 |
| Rewoquat V3282*7 | | 6.50 | | |
| Hydroxyethyl diphosphonic acid | 0.90 | 0.90 | 1.20 | 0.90 |
| Diethyleneamine pentamethyl phosphonic acid | 0.90 | 0.90 | 0.80 | 0.75 |
| Citric Acid | 7.5 | 8.0 | 7.5 | 8.5 |
| Perfume | 0.50 | 1.0 | 0.50 | 1.0 |
| Water & minors | Bal. | Bal. | Bal. | Bal. |

*1Silicone emulsion SE39, available from Wacker
*2Silicone 3565, available from Dow Corning
*3Succinoglycan Gum, available from Rhodia
*4Xanthan gum, available from Aldrich
*5substituted 5-pyrimidinol(2-N,N-dimethylamino-4,6-dimethyl-5-hydroxypyrimidine)
*6substituted 3-pyridinol(2,4-dimethyl-6-N,N-dimethylamino-3-hydroxypyridine)
*7Di(stearoyloxyethyl) Dimethyl ammonium chloride, 85% activity, available from Goldschmidt All documents cited in the Detailed Description of the Invention are, are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A laundry detergent composition comprising (a) a surfactant; (b) from about 0.005% to about 5% by weight of the composition of an antioxidant, wherein the antioxidant is selected from the group consisting of a substituted 3-pyridinol which has the structure

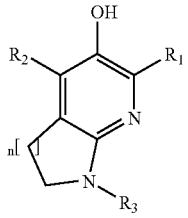

wherein n=1 or 2; R1 and R2 are independently selected from the group consisting of hydrogen, methyl, ethyl, propyl, n-butyl, and t-butyl; and mixtures thereof, and or substituted 3-pyridinol comprises: an O—H bond dissociation enthalpy of less than about 80 kcal/mol and an ionization potential of more than about 140; and (c) from about 0.01% to 10% by weight of the composition of a polymeric dye transfer inhibiting agent.

2. The composition according to claim 1, wherein the substituted 3-pyridinol has the selected from the group consisting of:

i)

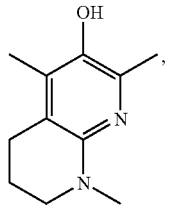

ii)

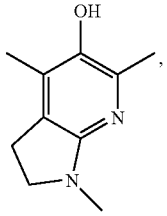

and a mixture thereof.

3. The composition of claim 1, wherein said polymeric dye transfer inhibiting agent is selected from the group consisting of polyamine N-oxide polymers, and mixtures thereof.

4. The composition according to claim 3, further comprising from about 0.1% to about 8% by weight of the composition of a dye-fixative agent.

5. The composition of claim 4, wherein the antioxidant comprises from about 0.01% to about 1% by weight of the composition.

* * * * *